US007849556B1

(12) United States Patent
Jansen

(10) Patent No.: US 7,849,556 B1
(45) Date of Patent: Dec. 14, 2010

(54) EXTRACTION WITH HEATED CLEANING FLUID

(75) Inventor: John L. Jansen, Tai Po (CN)

(73) Assignee: Bissell Homecare Inc., Grand Rapids, MI (US)

( * ) Notice: Subject to any disclaimer, the term of this patent is extended or adjusted under 35 U.S.C. 154(b) by 1228 days.

(21) Appl. No.: 11/275,392

(22) Filed: Dec. 29, 2005

Related U.S. Application Data

(60) Provisional application No. 60/593,265, filed on Dec. 30, 2004.

(51) Int. Cl.
*A47L 5/00* (2006.01)
*E01H 1/08* (2006.01)

(52) U.S. Cl. ..... 15/320; 134/21

(58) Field of Classification Search ..... 15/320, 15/340.1, 340.3, 383, 49.1, 50.1, 52.1; 134/21, 134/105

See application file for complete search history.

(56) References Cited

U.S. PATENT DOCUMENTS

| | | | | |
|---|---|---|---|---|
| 1,969,036 | A * | 8/1934 | Riebel, Jr. | 401/2 |
| 2,870,016 | A | 1/1959 | Day et al. | |
| 3,335,448 | A * | 8/1967 | Knestele | 401/2 |
| 5,016,313 | A * | 5/1991 | Yonehara | 15/320 |
| 5,309,593 | A * | 5/1994 | Yonehara | 15/92 |
| 6,131,237 | A | 10/2000 | Kasper et al. | |
| 6,173,905 | B1 | 1/2001 | Schultes | |
| 2005/0022333 | A1 * | 2/2005 | McDowell et al. | 15/320 |

* cited by examiner

*Primary Examiner*—David B Thomas
(74) *Attorney, Agent, or Firm*—McGarry Bair PC

(57) ABSTRACT

A portable carpet cleaning apparatus comprises a module for movement along a surface, a cleaning fluid dispensing system for applying a cleaning fluid to the surface, optionally, a rotating brush assembly, a suction nozzle and a vacuum source fluidly connected to the suction nozzle and a heating element for heating the cleaning fluid immediately prior to the application of the cleaning fluid to the surface.

18 Claims, 6 Drawing Sheets

EXTRACTION WITH HEATED CLEANING FLUID

CROSS-REFERENCE TO RELATED APPLICATION

This application claims the benefit of U.S. provisional application Ser. No. 60/593,265, filed Dec. 30, 2004, which is incorporated herein by reference in its entirety.

BACKGROUND OF THE INVENTION

1. Field of the Invention

This invention relates to the extraction of dirt from surfaces such as carpet and bare floors. In another of its aspects, the invention relates to an extraction cleaning machine that applies a heated cleaning fluid to a surface to be cleaned with a minimum of heat loss prior to application to the surface. In another of its aspects, the invention relates to an extraction cleaning machine which is adapted to heat a cleaning fluid in close proximity to a surface to be cleaned. In another of its aspects, the invention relates to a mop that generates steam in close proximity to the surface to be cleaned. In yet another of its aspects, the invention relates to a method for extracting dirt from a surface to be cleaned by heating a cleaning fluid in close proximity to a surface to be cleaned to minimize heat loss between the time the cleaning fluid is heated and the time that the cleaning fluid is applied to the surface to be cleaned.

2. Description of the Related Art

Upright extraction cleaning machines have been used for removing dirt from surfaces such as carpeting and rugs. The known extraction cleaning machines can be in the form of a canister-type unit, as disclosed in U.S. Pat. No. 5,237,720 to Blase et al., or an upright unit, as disclosed in U.S. Pat. No. 6,131,237 to Kasper et al., both of which are incorporated herein by reference.

Both types of units contain a fluid delivery system for depositing a quantity of cleaning fluid on the carpet surface. The cleaning fluid dissolves the dirt, removes the dirt from the carpet fibers, and places the dirt in suspension, which aids in the extraction of dirt from the carpet. The cleaning fluid is typically dispensed on the carpet through one or more dispensers, such as spray nozzles, in the extraction cleaning machine where it can be worked into the carpet by one or more rotating brush-type agitators.

U.S. Pat. No. 6,131,237 to Kasper et al. discloses heating a cleaning fluid with an in-line heater between a cleaning fluid solution tank and the cleaning fluid dispenser. It is also known to heat cleaning solution with an immersion heater located in the solution tank, prior to depositing the cleaning fluid on the surface. Both types of heaters are generally located in the cleaning machine at a point somewhat removed from the cleaning fluid dispenser. The dispenser spray nozzles are frequently located in an upper wall of a chamber that encloses the rotating brushes. Thus, the cleaning fluid must pass through the chamber to contact the carpet surface. Cooling of the heated cleaning fluid can occur during the time that the cleaning fluid travels from the heater to the fluid dispenser. Additional cooling can occur as the cleaning fluid passes through the chamber to the carpet. This cooling can reduce the cleaning effectiveness of the cleaning fluid. Kasper et al. also disclose heating a cleaning solution in an in-line heater that is in a cleaning head attached to a wand that is connected to a canister extraction unit.

Increasing the temperature of the cleaning fluid in a conventional extractor is limited by the power available to generate heat and the potential for the cleaning fluid to overheat, pressurize, and damage the cleaning fluid delivery system.

In-line heaters also suffer from clogging as a result of the buildup of sediment and other residues. Tank heaters can be slow to heat the cleaning fluid, and the tank must typically be insulated, thereby adding volume and weight to the cleaning machine.

Further, the carpet is relatively cool with respect to the heated cleaning fluid and thus extracts heat from the heated cleaning fluid as it is applied to the carpet surface, thereby diminishing the cleaning power of the cleaning solution. This problem may be overcome somewhat by raising the temperature of the cleaning solution. However, in conventional domestic carpet extractors, the power to continuously raise the temperature of the cleaning solution is limited by domestic circuits in the United States and Canada. Further, the volume of cleaning solution with respect to the area of the carpet is relatively small so that the cleaning solution has limited ability to raise the temperature of the carpet to limit the cooling of the heated cleaning solution as it is applied to the carpet.

Steam generating machines have been used to clean and sanitize hard-surface floors. Known steam machines can be in portable hand-held form or in the form of an upright machine. An example of a commercially-available stick-type upright steam machine is marketed by BISSELL Homecare, Inc. under the name Steam Mop™. All of the known prior art locates the steam generator remote from the dispensing opening.

The effectiveness of the cleaning process can be enhanced by using an extractor that can heat the cleaning fluid immediately prior to its application to the carpet or hard-surface floor.

SUMMARY OF THE INVENTION

The invention relates to a portable surface cleaning apparatus that includes a cleaner head for movement along a surface to be cleaned; a cleaning fluid supply system, including at least one cleaning fluid dispenser mounted to the cleaner head and adapted to apply a cleaning fluid to a surface to be cleaned; a suction nozzle mounted to the cleaner head; a vacuum source in fluid communication with the suction nozzle for removing cleaning fluid from the surface through the suction nozzle; and a heating element associated with the cleaner head for heating the cleaning fluid.

According to one embodiment of the invention, the heating element is positioned between the at least one dispenser and the surface to be cleaned for heating the cleaning fluid subsequent to discharge from the at least one dispenser.

In a specific embodiment, the heating element comprises a rectilinear body that extends horizontally and parallel to the suction nozzle. In another specific embodiment, the heating element comprises a cylinder that is mounted for rotation about a horizontal axis. In yet another specific embodiment, the at least one dispenser is mounted for discharge of the cleaning fluid onto the heating element prior to the fluid being applied to the surface. In still another specific embodiment, the heating element comprises a chamber that has at least one fluid outlet and a fluid inlet, the fluid inlet is fluidly connected to the at least one dispenser whereby the cleaning fluid passes from the at least one dispenser into the chamber where it is heated and the heated cleaning fluid passes through the at least one fluid outlet to the surface.

In yet another embodiment of the invention, the heating element is adapted to generate steam.

The cleaner head can have a rotating brush assembly mounted for scrubbing the surface to be cleaned. Further, the heating element is positioned between the suction nozzle and the rotating brush assembly.

In yet another embodiment of the invention, the heating element is adapted to contact and thereby heat the surface to be cleaned during movement of the cleaner head along the surface; and the heating element is positioned so that the cleaning fluid is heated at least in part by the heated surface as the cleaning fluid is applied to the surface to be cleaned.

Further according to the invention, a method for cleaning a surface such as a carpet or a bare floor comprises the steps of applying a heated cleaning fluid to the surface, recovering soiled cleaning fluid from the surface by the application of suction to the surface, and heating the cleaning fluid as it is applied to the surface to be cleaned.

In one embodiment, the heating step comprises heating the surface to be cleaned prior to the application of cleaning fluid to the surface. Further, the heating step further comprises heating the cleaning fluid before it is applied to the surface. In yet another embodiment of the invention, the steps of heating the cleaning fluid prior to application of cleaning fluid to the surface and the step of heating the surface to be cleaned prior to the application of cleaning fluid to the surface is carried out by a common heater.

DESCRIPTION OF AN EMBODIMENT OF THE INVENTION

Figure 1:
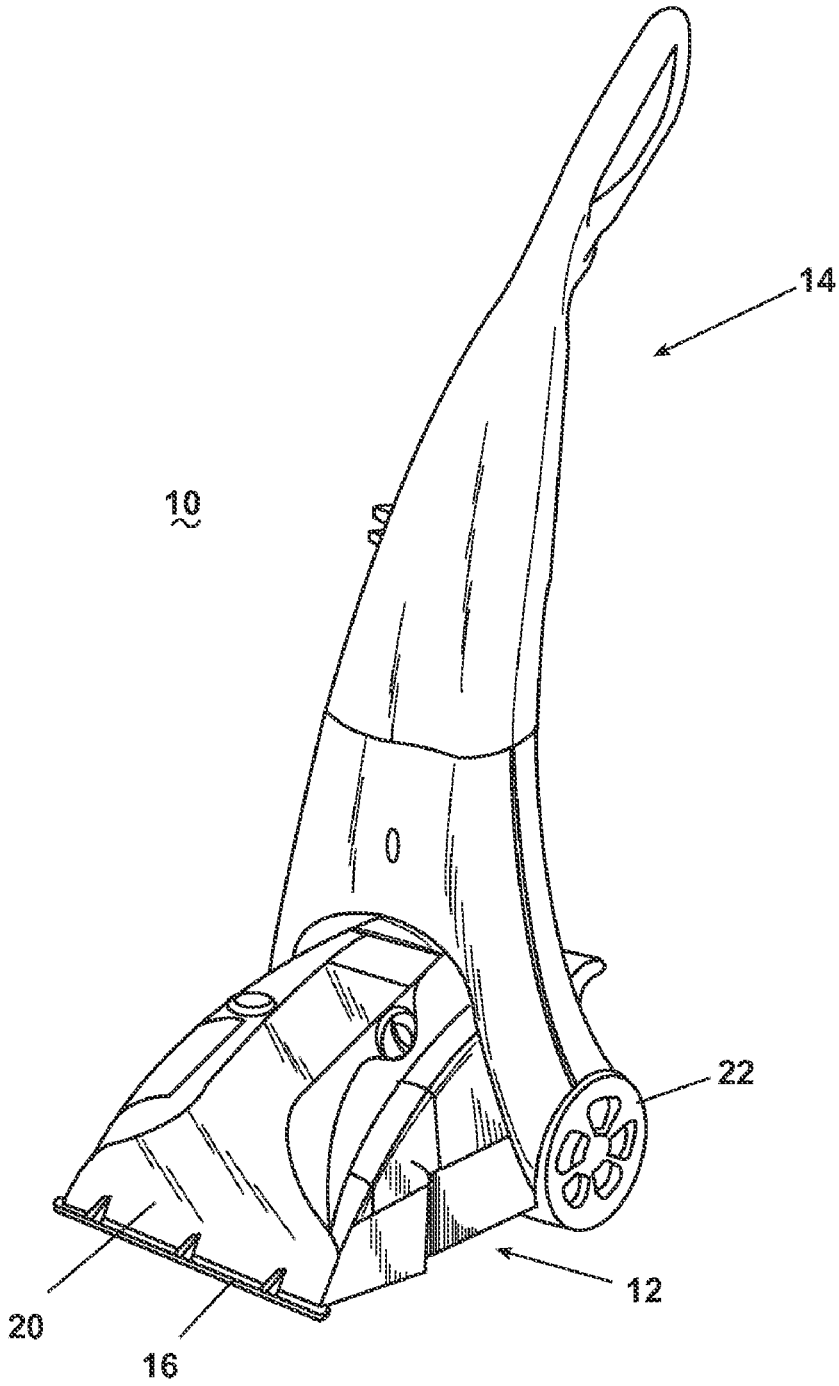
FIG. 1 is a perspective view of an upright extraction cleaning machine according to the invention.

Referring now to the drawings and to FIG. 1 in particular, an embodiment of an extraction cleaning machine 10 includes a base module 12 adapted with wheels 22 to roll across a carpet surface, and an upright handle assembly 14 pivotally mounted to a rear portion of the base module 12. The invention is described and illustrated herein with respect to an upright carpet extraction cleaning machine that has a cleaner head in a base module, although the invention can also be utilized in a canister-type cleaning machine that includes a wand and a cleaner head, or a machine for cleaning other surfaces, such as hard-surface floors. The upright extraction cleaning machine 10 is a generally well-known device comprising several of the features and operations described in U.S. Pat. No. 6,131,237 to Kasper et al., which is incorporated herein by reference in its entirety. Such well-known features and operations will not be described in detail herein, except as otherwise necessary for a complete understanding of the invention. Canister-type cleaning machines are well known and are disclosed, for example, in the U.S. Pat. No. 5,237,720 to Blase et al., which is incorporated herein by reference in its entirety.

Figure 2:
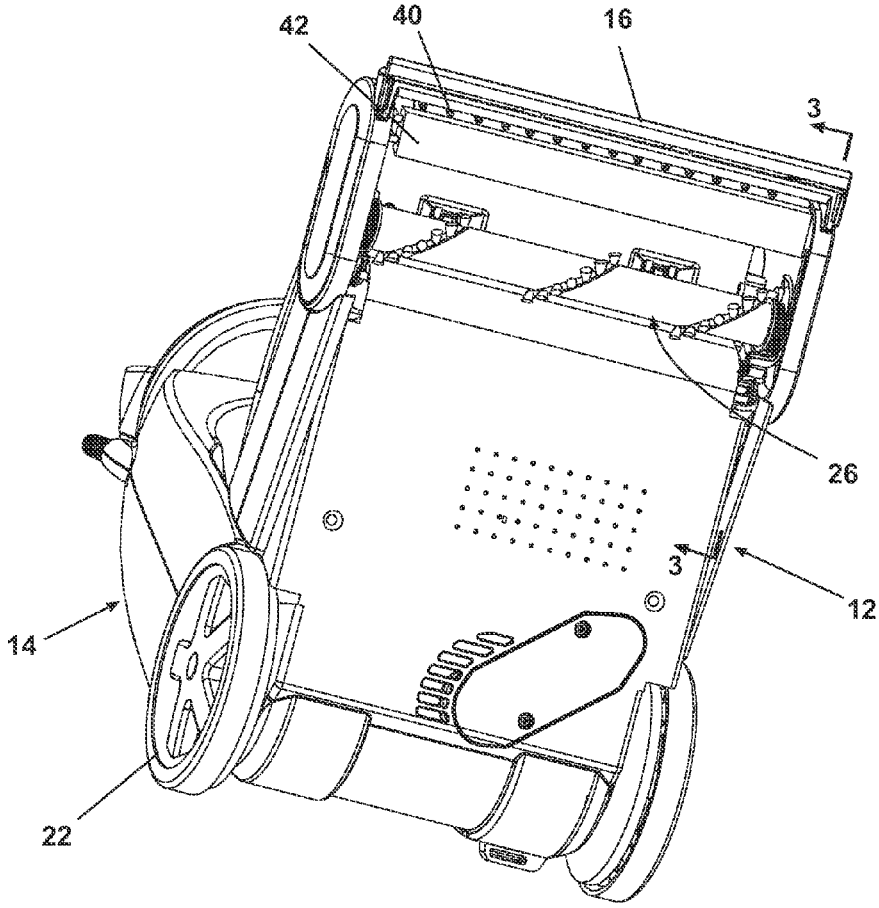
FIG. 2 is a perspective view of an underside of the upright extraction cleaning machine illustrated in FIG. 1 and illustrating a heating element for heating cleaning fluid to be applied to a surface.

As illustrated in FIGS. 1 and 2, the base module 12 includes a housing 20 having a forward portion 16. As illustrated also in FIG. 3, the housing 20 encloses a motor 24 operating a well-known vacuum source (not shown) in fluid communication with a suction nozzle 28, a rotating brush assembly 26, a liquid delivery system comprising a plurality of dispensers 40 for dispensing cleaning fluid on the carpet, liquid reservoirs (not shown), and the like. FIG. 2 illustrates a plurality of dispensers 40. However, any number of dispensers 40 can be employed depending upon, for example, the pattern of liquid delivery from each dispenser, the volume of liquid to be delivered to a selected area, and the width of the cleaning machine 10.

Figure 3:
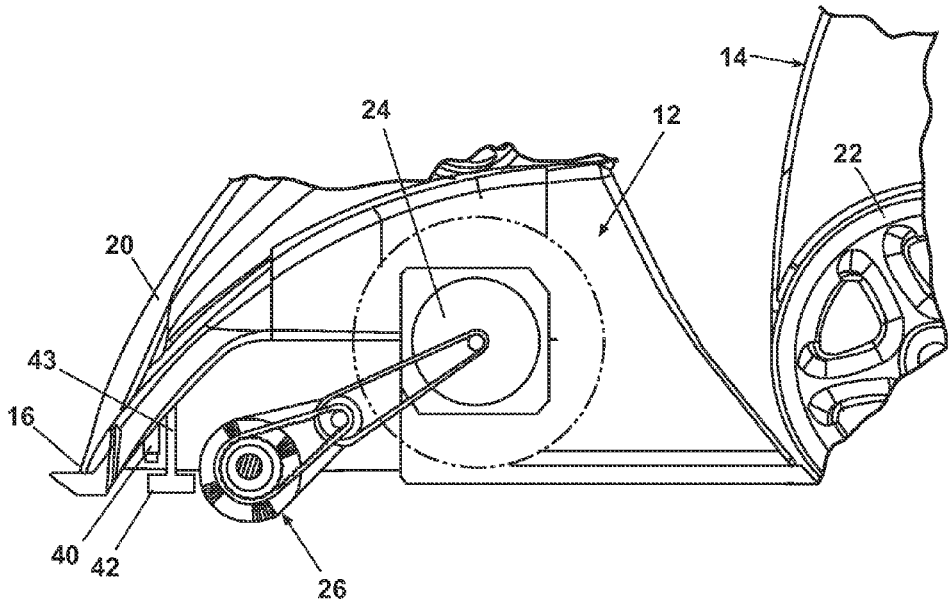
FIG. 3 is a partial sectional side view of the upright extraction cleaning machine of FIG. 1 taken along lines 3-3 of FIG. 2, illustrating the location of the heating element and a cleaning fluid spray nozzle.

As illustrated in FIGS. 2 and 3, the dispensers 40 are located intermediate the suction nozzle 28 and the brush assembly 26, and above a heating element 42 which is supported adjacent the brush assembly 26 by a support element 43. The heating element 42 is illustrated as a drip plate as hereinafter described. The support element 43 comprises a support structure, such as a strut, a hanger, and the like, suitable for incorporation into the base module 12 for fixedly supporting the heating element 42 in a selected position relative to the dispensers 40, the suction nozzle 28, and the brush assembly 26. The heating element 42 can also be removably attached to the base module 12 through, for example, a receptacle mounted to the base module 12 and adapted to hold the heating element 42 therein, utilizing a connection such as a snap-fit or interference fit connection (not shown).

In one embodiment, the heating element 42 is attached to the base module 12 so that the underside is immediately above the carpet surface. In another embodiment, the heating element 42 is attached to the base module 12 so that the underside is in contact with the carpet surface. In yet another embodiment, the heating element 42 is attached to the base module 12 through a movable assembly that enables the heating element 42 to be selectively positioned in contact with the carpet surface, or at some selected distance above the carpet surface. Preferably, the heating element 42 is fabricated of cast aluminum, although other thermally conductive materials sufficiently unaffected by the deposition of the cleaning fluid thereon can be used.

The dispensers 40 are adapted to discharge cleaning fluid onto the heating element 42 for heating and delivery to the carpet surface. Thus, cleaning fluid can be discharged through the dispensers 40 onto the heating element 42 where it is heated, and thence to the carpet surface, during forward travel of the extraction cleaning machine 10, to be scrubbed by the brush assembly 26. Alternatively, the heating element 42 can be positioned in contact with the carpet surface to heat the carpet, followed by delivery of the cleaning fluid from the dispensers 40 directly onto the carpet surface where the cleaning fluid is heated by the elevated temperature of the carpet. In yet another alternative, the heating element 42 can heat the carpet surface, and the dispensers 40 can discharge cleaning fluid onto the heating element 42 so that the cleaning fluid is heated by both the heated carpet and the heating element 42. Rearward travel of the extraction cleaning machine 10 will result in the cleaning fluid being extracted from the surface through the suction nozzle 28 in a well-known manner.

Heating of the carpet surface can be advantageous in enhancing the cleaning process. The carpet is relatively cool compared to the heated cleaning solution. Thus, the heated cleaning fluid will give up heat to the carpet as it is applied to the carpet surface and thereby be cooled as a result. Heating of the carpet will lessen or minimize the loss of heat in the cleaning fluid and enhance the cleaning process. Further, the cleaning fluid can be heated solely by the heated carpet without heating the cleaning fluid before application to the carpet surface if sufficient heat is applied to the carpet by the heating element 42.

Figure 4:
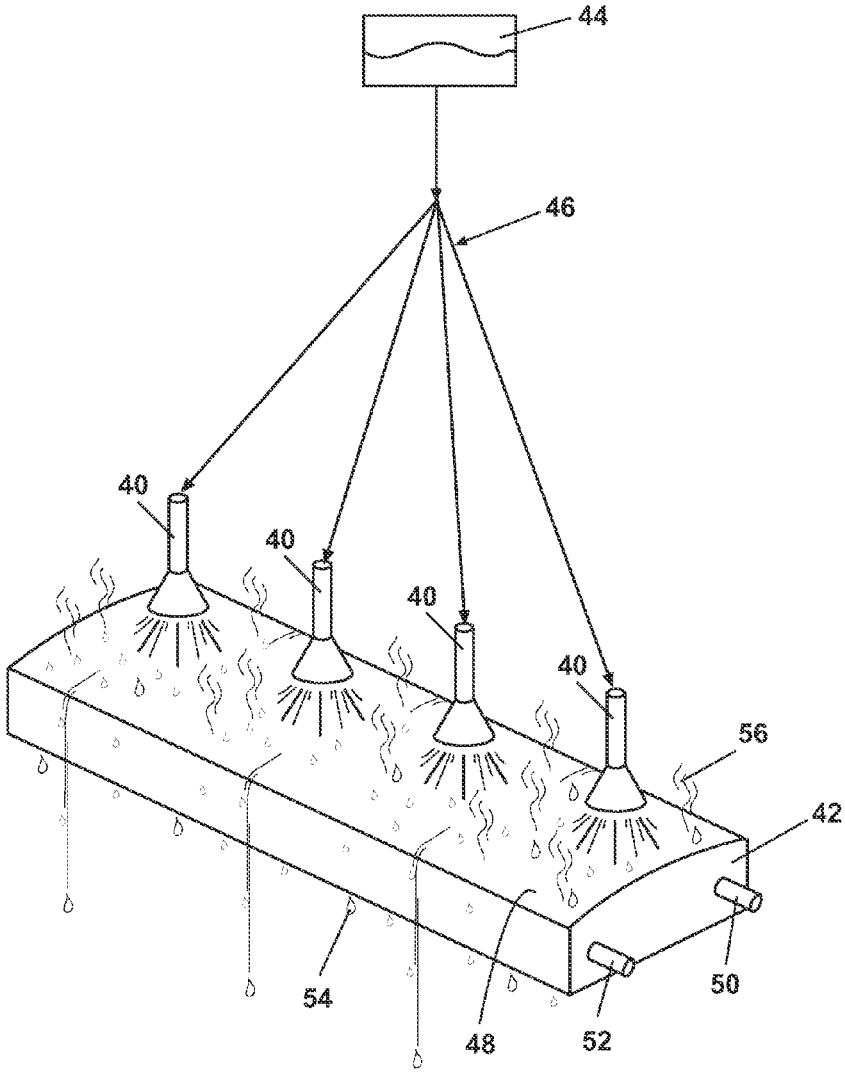
FIG. 4 is a perspective view of the heating element illustrated in FIG. 3.

FIG. 4 illustrates a first embodiment of the heating element 42. The heating element 42 comprises a generally rectilinear, planar, plate-like body having an upper plate surface 48 and adapted to extend laterally across the full width of the extraction cleaning machine 10. The upper plate surface 48 can be planar or somewhat convex so that liquid deposited on the surface 48 flows to the longitudinal edges of the heating element 42 and thence to the carpet.

The heating element 42 is provided with a suitable heating element, such as a well-known calorimeter rod element (not shown), electrically interconnected through electrical leads 50, 52 to the cleaning machine power supply. The heating element can be electrically connected with a suitable operational and temperature control mechanism (not shown) for selectively activating and deactivating the heating element, and for adjusting the temperature of the heating element 42. Thus, the heating element 42 can be selectively deactivated when the heating of the liquid is not desired or when liquid is not being sprayed onto the carpet, or activated when heating of the liquid is desired. Furthermore, the temperature of the heating element 42 can be controlled so that heated liquid at one or more selected temperatures up to and including steam is produced. The heating element 42 can be heated using other heating devices such as a foil-type heater affixed to the upper surface of the heating element 42, a chemical heater, a resistance heater, and the like.

As illustrated in FIG. 4, cleaning fluid is delivered using suitable control devices, such as valves, switches, and the like, from a cleaning fluid reservoir 44 through one or more cleaning fluid supply lines 46 to the dispensers 40. Cleaning fluid flowing from the dispensers 40 are delivered to the upper plate surface 48 and heated upon contact with the surface 48. Depending upon the temperature to which the heating element 42 is heated, heated cleaning fluid 54 is generated, and flows from the upper plate surface 48 to the carpet surface, or the cleaning fluid creates steam 56, or a mixture of steam 56 and liquid 54, for delivery to the carpet surface.

Figure 5:
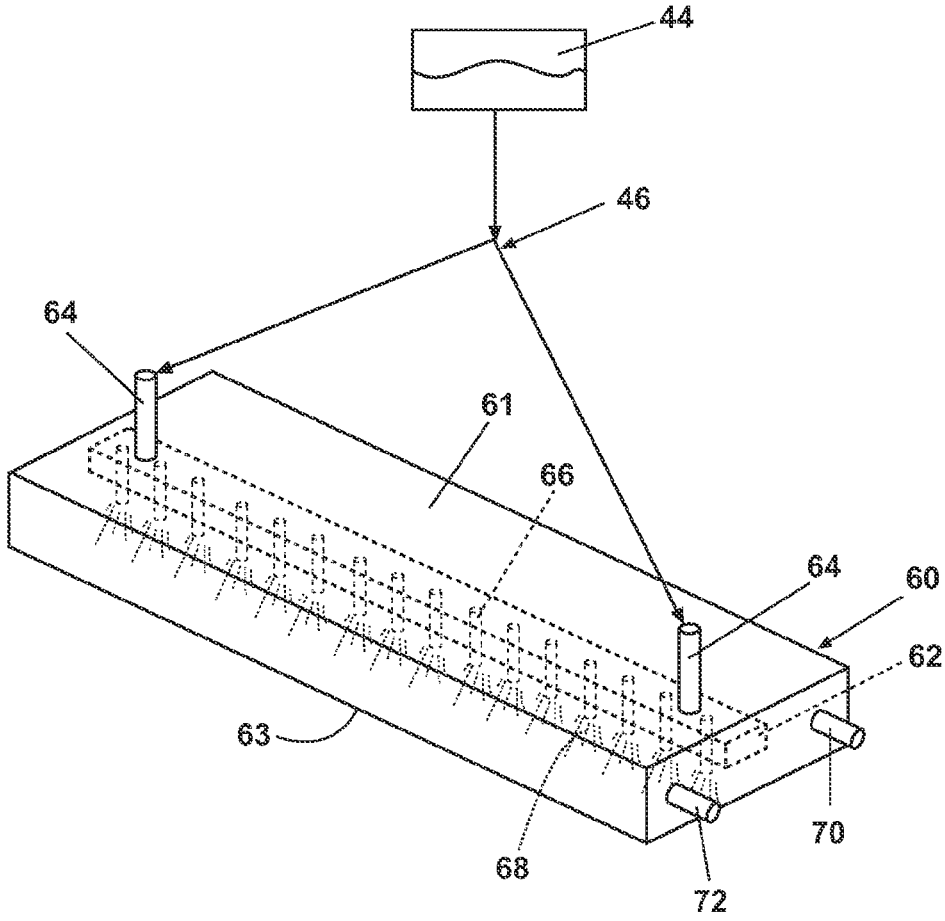
FIG. 5 is a perspective view of a second embodiment of the heating element according to the invention.

FIG. 5 illustrates a second embodiment of a heating element 60. The heating element 60 comprises a generally rectilinear, planar, plate-like body having an upper plate surface 61 and a lower plate surface 63 in parallel, opposed juxtaposition. The heating element 60 is adapted to extend laterally across the full width of the extraction cleaning machine 10. As with the heating element 42, the heating element 60 is provided with a suitable heating element (not shown) and is electrically interconnected through electrical leads 70, 72 to the cleaning machine power supply and to an operational and temperature control device (not shown). The heating element 60 is provided with an internal closed channelway 62 extending longitudinally therealong, fluidly connected to a pair of cleaning fluid inlets 64 extending away from the upper surface 61 and fluidly connected to the reservoir 44 through cleaning fluid supply lines 46, and a plurality of cleaning fluid outlets 66 fluidly connecting the channelway 62 to the lower surface 63. The cleaning fluid outlets 66 function as dispensers for delivery of cleaning fluid to the carpet surface. The heating element is adapted to raise the temperature of the heating element 60 in order to heat cleaning fluid introduced into the channelway 62 from the cleaning fluid reservoir 44. Cleaning fluid is delivered from a cleaning fluid reservoir 44 through one or more cleaning fluid supply lines 46 which are fluidly connected to the cleaning fluid inlets 64.

Cleaning fluid delivered to the cleaning fluid inlets 64 enters the channelway 62 where it is heated to a selected temperature. The heated liquid 68 can flow from the cleaning fluid outlets 66 onto the carpet surface. By raising the temperature of the heating element 60 sufficiently, steam can be generated in the channelway 62 for delivery to the carpet surface through the liquid outlets 66.

Figure 6:
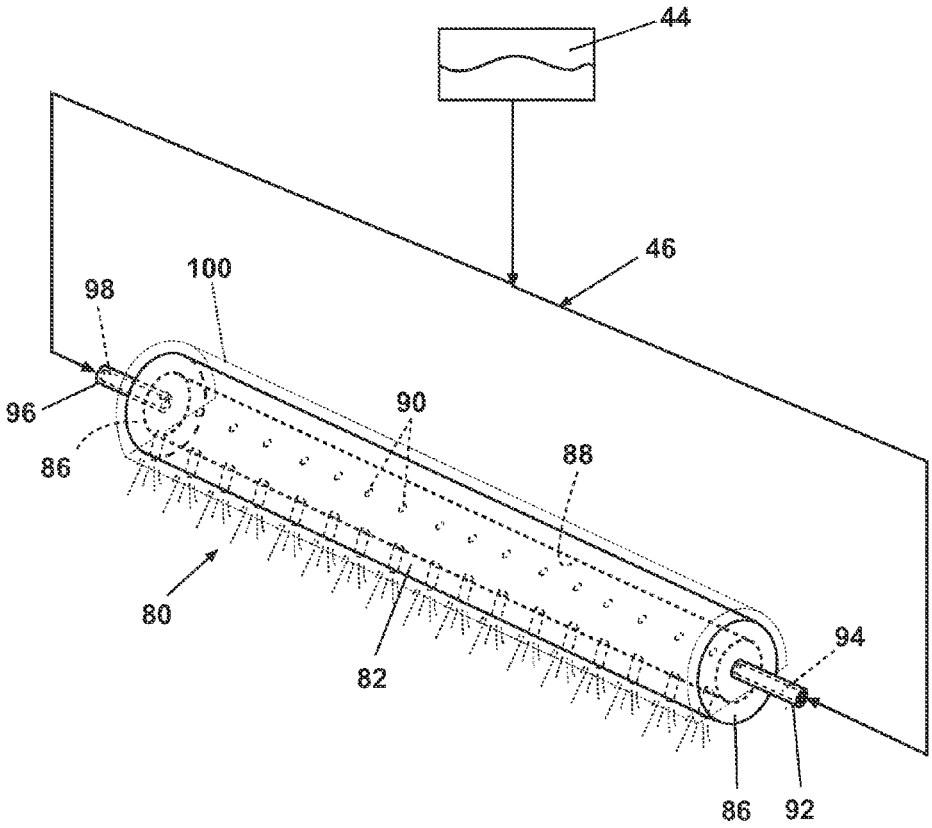
FIG. 6 is a perspective view of a third embodiment of the heating element according to the invention.

FIG. 6 illustrates a third embodiment of a heating element 80 comprising a rotating roller or cylinder adapted for rotatable contact with the surface to be cleaned and delivery of steam or heated cleaning fluid thereto. The cylinder 80 comprises an elongated annular wall 82 terminating at each end in a circular end wall 84, 86 to define a cylindrical steam chamber 88 extending coaxially the length of the cylinder 80 between the end walls 84, 86. An array of steam nozzles 90 extends through the annular wall 82 in fluid communication with the steam chamber 88. The number and spacing of the steam nozzles 90 can be selected based upon the pattern of steam delivery from each steam nozzle 90, the volume of steam to be delivered to a selected area of the surface to be cleaned, and the length of the cylinder 80. The diameter of the steam nozzles 90 can be selected to control the flow of steam through the nozzles 90.

Extending coaxially from each end wall 84, 86 is a stub axle 92, 96, respectively, having a bore 94, 98, respectively, extending coaxially therethrough for fluid communication with the steam chamber 88. The stub axle 92, 96 is preferably journaled into a bearing fixedly attached to the housing 20 and having a fluid-tight connector enabling the stub axle 92, 96 to rotate in the bearing while maintaining fluid communication between the bore 94, 98 and the cleaning fluid supply line 46 extending from the cleaning fluid reservoir 44. It is anticipated that a person having an ordinary level of skill in the relevant art will be familiar with a suitable means for connecting the cleaning fluid supply line 46 to the stub axles 92, 96 in order to enable the cylinder 80 to rotate while maintaining a fluid-tight connection between the bores 94, 98 and the fluid supply line 46. A one-way valve (not shown) can also be installed in each bore 94, 98 to prevent steam and liquid cleaning fluid from migrating from the steam chamber 88 to the cleaning fluid supply line 46 in order to direct the steam through the nozzles 90.

The cylinder 80 can be partially surrounded with an elongated, semicircular cowl 100 (shown in phantom in FIG. 6) extending coaxially along and around an upper portion of the cylinder 80. The cowl 100 can be integrally formed in the housing 20, or can be a separate structural element attached to the housing 20 in a suitable manner. The cowl 100 prevents steam from extending upwardly from the steam nozzles 90 as the cylinder 80 rotates, and directs the steam downwardly towards the surface to be cleaned.

The cylinder 80 is also fabricated with a heating element (not shown) suitable for heating the cylinder 80 to a temperature sufficient to convert cleaning fluid delivered from the cleaning fluid reservoir 44, through the cleaning fluid supply line 46 and the bore 94, 98, and into the steam chamber 88, from a liquid state into steam. An example of such a heating element is a flexible, resistance-type wire-wound or etched foil heating element laminated between thin layers of insulative, high temperature fiberglass-reinforced silicone rubber, such as marketed by Electro-Flex Heat, Inc., of Bloomfield, Conn. Alternately, one or more calorimeter rod elements can be incorporated into the cylinder wall 82 to heat the cylinder 80. Electrical leads from the heating element can be extended through a bore 94, 98 to the cleaning machine power supply for electrically energizing the heating element and to an operational and temperature control device (not shown). The interconnection of the electrical leads and the source of electricity is adapted to enable rotation of the cylinder 80 while maintaining electrical connectivity between the electrical leads and the energy source. The heating element can be attached to the interior surface of the annular wall 82 through an adhesive or other suitable means.

During operation of the extraction cleaning machine 10, the cylinder 80 is in contact with the surface to be cleaned and rotates over the surface during translation of the machine 10 along the surface. Heating of the cylinder 80 converts the cleaning fluid from a liquid to steam. The steam passes through the nozzles 90 into and over the surface. The cowl 100 directs the steam downwardly toward the surface rather than upwardly into the interior of the housing 20. Alternatively, the cylinder 80 can be heated to a temperature less than that required to convert the cleaning fluid from a liquid to steam in order to deliver heated cleaning fluid through the nozzles 90 to the surface to be cleaned. Furthermore, the contact of the cylinder 80 with the surface to be cleaned will heat the surface and further facilitate the loosening and removal of soil.

FIGS. 4-6 illustrate embodiments which are utilized as the sole heating element for heating cleaning fluid prior to delivery of the cleaning fluid to the carpet. However, the cleaning fluid can be heated using a conventional in-line heater or tank heater, with the heating elements illustrated in FIGS. 4-6 utilized solely to generate steam. Furthermore, the heating plate-like elements can be either supported above the carpet surface or in contact with the carpet surface in order to force the heated cleaning fluid and/or steam into the carpet, and to heat the carpet through contact with the heating element. If the heating elements in FIGS. 4-6 are positioned in contact with the surface to be cleaned, they can be operated to heat both the surface to be cleaned and the cleaning fluid, or to heat just the surface to be cleaned, with the cleaning fluid heated by the elevated temperature of the surface.

In another embodiment, the heating element 42, 60 is affixed in a similar manner to a generally conventional upright steam mop machine (not shown) comprising a base module and an upright pivoting handle similar to that found in the commercially available BISSELL Homecare, Inc. Steam Mop™. The heating element is preferably located in the base module immediately above the surface to be cleaned. A fluid reservoir is located in the upright handle. Fluid is allowed to flow under the force of gravity to the heating element through a user-actuated valve. Upon contact with the heating element, the fluid flashes off as steam and is directed to the surface to be cleaned as previously described.

The use of a heating element immediately above a surface being cleaned can facilitate the cleaning of the surface by raising the temperature of cleaning fluid applied to the surface immediately prior to application of the cleaning fluid. Heating the cleaning fluid immediately prior to its application reduces the cooling of the cleaning fluid that would otherwise occur with in-line heaters and tank heaters. The heating element can comprise a relatively small, lightweight body, resulting in a less expensive lighter weight machine. The use of a heating element at the terminus of the liquid delivery system reduces the potential for overheating and pressurizing of the system. The heating element can generate both steam and heated liquid, thereby optimizing the cleaning effectiveness of the cleaning fluid. Furthermore, sediment and other deposit buildup is minimized in the heating element and delivery lines. Finally, the use of a heating element lends itself well to low pressure systems (i.e. gravity feed), and eliminate the necessity of a pump for delivering the heated liquid to the dispensers.

The use of a heating element to provide heat to a surface to be cleaned enhances the cleaning process because it reduces the heat loss to the cleaning solution in the carpet or other surface itself. The heated carpet thus adds heat to the heating solution whether or not the cleaning solution has been heated prior to application of the cleaning solution to the floor.

While the invention has been specifically described in connection with certain specific embodiments thereof, it is to be understood that this is by way of illustration and not of limitation. For example, the invention is equally applicable to a canister extraction cleaner with a wand and a cleaner head that includes the heater between cleaning fluid dispensers and the surface to be cleaned. The invention is also applicable to hand held cleaners that include a cleaner head and other elements of an extractor in a single housing. Reasonable variation and modification are possible within the scope of the forgoing disclosure and drawings without departing from the spirit of the invention which is defined in the appended claims.

What is claimed is:

1. A portable surface cleaning apparatus, comprising:

a cleaner head for movement along a surface to be cleaned;

a fluid supply system, including at least one fluid dispenser mounted to the cleaner head and adapted to apply a fluid to a surface to be cleaned;

a suction nozzle mounted to the cleaner head;

a vacuum source in fluid communication with the suction nozzle for removing fluid from the surface through the suction nozzle; and a heating element associated with the cleaner head for heating the fluid comprising a cylinder that is mounted for rotation about a horizontal axis;

wherein the heating element is positioned between the at least one dispenser and the surface to be cleaned for heating the fluid subsequent to discharge from the at least one dispenser.

2. The portable surface cleaning apparatus of claim 1, wherein the at least one dispenser is mounted for discharge of the fluid onto the heating element prior to the fluid being applied to the surface.

3. The portable surface cleaning apparatus of claim 1, wherein the heating element comprises a chamber that has at least one fluid outlet, the chamber is fluidly connected to the at least one dispenser whereby the fluid passes from the at least one dispenser into the chamber to be heated and the heated fluid passes through the at least one fluid outlet to the surface.

4. The portable surface cleaning apparatus of claim 1, wherein the heating element is adapted to generate steam.

5. The portable surface cleaning apparatus of claim 1, and further comprising a rotating brush assembly mounted in the cleaner head for scrubbing the surface to be cleaned.

6. The portable surface cleaning apparatus of claim 5, wherein the heating element is positioned between the suction nozzle and the rotating brush assembly.

7. The portable surface cleaning apparatus of claim 1, wherein the heating element is adapted to contact and thereby heat the surface to be cleaned during movement of the cleaner head along the surface; and wherein the heating element is positioned so that the fluid is heated at least in part by the heated surface as the cleaning fluid is applied to the surface to be cleaned.

8. A portable surface cleaning apparatus, comprising:

a cleaner head for movement along a surface to be cleaned;

a fluid supply system, including at least one fluid dispenser mounted to the cleaner head and adapted to apply a fluid to a surface to be cleaned;

a suction nozzle mounted to the cleaner head;

a vacuum source associated with the cleaner head for removing fluid from the surface through the suction nozzle; and a cylindrical heating element mounted to the cleaner head adjacent the at least one dispenser for rotation about a horizontal axis and adapted to contact the surface to be cleaned during movement of the cleaner head along the surface;

wherein the heating element is positioned so that the fluid is heated at least in part by the heated surface as the cleaning fluid is applied to the surface to be cleaned.

9. The portable surface cleaning apparatus of claim 8, wherein the heating element comprises a rectilinear body that extends horizontally and parallel to the suction nozzle.

10. The portable surface cleaning apparatus of claim 8, wherein the at least one dispenser is positioned to discharge cleaning fluid from the cleaning fluid dispensing system into contact with the heating element prior to the application of fluid to the surface to be cleaned.

11. The portable surface cleaning apparatus of claim 8, wherein the heating element comprises a heated chamber that has at least one fluid outlet and a fluid inlet, the fluid inlet is fluidly connected to the at least one dispenser, and the fluid is discharged from the fluid dispensing system into the chamber to be heated and delivered through the at least one fluid outlet to the surface.

12. The portable surface cleaning apparatus of claim 8, wherein the heating element is adapted to generate steam.

13. The portable surface cleaning apparatus of claim 8, and further comprising a rotating brush assembly mounted to the module for scrubbing the surface to be cleaned.

14. The portable surface cleaning apparatus of claim 13, wherein the heating element is positioned between the suction nozzle and the rotating brush assembly.

15. A method for cleaning a surface such as a carpet or a bare floor comprising the steps of applying a heated fluid to the surface and recovering soiled fluid from the surface by the application of suction to the surface, and further comprising the step of heating the fluid as it is applied to the surface to be cleaned.

16. The method for cleaning a surface according to claim 15, wherein the heating step comprises heating the surface to be cleaned prior to the application of fluid to the surface.

17. The method of claim 16, wherein the heating step further comprises heating the fluid before it is applied to the surface.

18. The method of claim 17, wherein the steps of heating the fluid prior to application of fluid to the surface and the step of heating the surface to be cleaned prior to the application of fluid to the surface are carried out by a common heater.

* * * * *